United States Patent [19]

Childs

[11] 3,993,449

[45] Nov. 23, 1976

[54] APPARATUS FOR POLLUTION ABATEMENT

[75] Inventor: J. H. Childs, North Olmsted, Ohio

[73] Assignee: City of North Olmsted, North Olmsted, Ohio

[22] Filed: Apr. 7, 1975

[21] Appl. No.: 565,604

[52] U.S. Cl. ..... 23/277 C; 23/284; 423/212; 431/5; 431/8; 431/9; 431/353; 431/174; 110/8 A; 60/303

[51] Int. Cl.[2] ..... F23G 7/06

[58] Field of Search ..... 23/277 C, 284; 423/210, 423/212; 60/303; 431/5, 8, 9, 352, 353, 174, 175; 110/8 A

[56] References Cited

UNITED STATES PATENTS

| | | | |
|---|---|---|---|
| 2,889,002 | 6/1959 | Kocee | 23/277 C |
| 3,788,065 | 1/1974 | Markowski | 431/9 X |
| 3,872,664 | 3/1975 | Lohmann et al. | 431/9 X |
| 3,885,919 | 5/1975 | Pillard | 23/277 C |

*Primary Examiner*—James H. Tayman, Jr.
*Attorney, Agent, or Firm*—Fay & Sharpe

[57] ABSTRACT

A low pressure loss, two stage burner is provided wherein a portion of the effluent gases are admitted to a primary burner defining a primary combustion zone, recirculated within the primary combustion zone, mixed with a combustible fuel in the primary combustion zone and ignited by means of an ignition system. The remainder of the effluent gases bypass the primary burner and flow into a secondary burner defining a secondary combustion zone. Gases entering this zone are mixed with a combustible fuel and ignited by means of the combustion occurring in the primary combustion zone. The effluent gases admitted to the secondary combustion zone have turbulent recirculation vortices generated therein in order that the gases will remain closely spaced to the secondary burner sidewall as they travel generally axially through the secondary combustion zone. Gases exiting from the primary combustion zone travel axially through the secondary combustion zone and are returned to atmosphere at the exit end thereof along with those gases admitted to the secondary burner for combustion. A small portion of the effluent gases are advantageously employed to continuously cool the primary burner and the secondary burner may be lined with a refractory material to enhance combustion in the secondary combustion zone.

16 Claims, 6 Drawing Figures

130
118
126
128
4
124
114
3
5
6
112
116
134
158
C
176
30
76
80
20
A
c
98
46
44
50
48
b
40
42
38
a
d
e
120
122
96
86
110
100
136
102
166
138
152
74
88
90
92
94
72
10
70
B
156
f
180
32
78
82
160
150
164
84
162

APPARATUS FOR POLLUTION ABATEMENT

BACKGROUND OF THE INVENTION

This invention pertains to the art of pollution abatement and more particularly to effecting combustion in effluent gases having undesirable odorants therein.

The invention is particularly applicable to consuming odorants contained in the gaseous effluent from any plant, factory or facility in order to convert these odorants to non-objectionable matter and will be described with particular reference thereto; however, it will be appreciated by those skilled in the art that the invention has other applications and may be advantageously employed in any number of other environments.

Many factories, chemical process plants, waste water treatment plants, sewage treatment plants and other like facilities produce malodorous gaseous effluents which are considered to be objectionable by persons who are exposed to them. Heretofore, any number of means have been variously employed in an effort to successfully overcome these objectionable odors. Among these prior efforts and techniques have been such devices as burners, ozonators, scrubbers and the injection of chemicals intended to alter or mask the malodorous species. However, and despite all these attempts to reduce objectionable odors, many facilities which have employed the available prior devices are still considered to produce objectionable odors.

Of all the various techniques known for consuming odorants in effluent gases, the simplest, most reliable and most effective method for substantially reducing or eliminating odors due to organic chemical species is generally considered to be a burner. However, most commercially available burners are not specifically designed for odor consuming use. The design of typical available burners, together with the low inlet pressure available with existing, economical blowers which deliver the effluent gas to the burners, results in insufficient mixing of the odorants into the flame, insufficient outlet temperature levels and insufficient outlet temperature uniformity. Insufficient outlet temperature levels or insufficient outlet temperature uniformity permits the escape of odorants back into the atmosphere because they are not oxidized in the cooler regions of the outlet gas stream.

An advantage is potentially available from a burner if the burner can be designed to operate over a wide range of input gas flow rates. With such a design and after serving to eliminate the principal source of odors emanating from a factory or other facility, the burner could later serve to also burn away other odorants which might be subsequently detected as emanating from other areas of the facility and which may then also be piped to the burner.

BRIEF DESCRIPTION OF THE PRESENT INVENTION

The present invention contemplates a new and improved method and apparatus which overcomes all of the above referred to problems and others and provides a new two stage burner which provides the above noted advantages and is simple, economical, reliable, efficient and readily adaptable for use in a plurality of different environments.

In accordance with the present invention, there is provided a low pressure loss two stage burner for oxidizing gaseous odorants contained in a supply of input or effluent gases. The burner itself is comprised of an elongated burner housing having a gas flow passageway interconnecting a gas inlet end and a gas outlet end. A primary burner, defining a primary combustion zone, is disposed in the housing and spaced from the gas inlet toward the gas outlet. The primary burner includes first means for allowing at least a portion of a supply of input or effluent gases to enter into the primary combustion zone and first means are also provided for supplying a combustible fuel to the combustion zone for mixing with the input or effluent gases received therein. An ignition structure is employed to actually ignite the fuel and input gas mixture in the combustion zone. A secondary burner is disposed in the housing adjacent the downstream end of the primary burner so that the exit end of the primary burner is in gas flow communication with the upstream or entrance end of the secondary burner. This secondary burner defines a secondary combustion zone and includes second means for allowing the remainder of the input gases to flow therethrough. Means disposed adjacent the entrance of the secondary burner produce turbulent recirculation vortices of the gas whereby the gases pass through the secondary combustion zone in a position closely spaced to the burner inner sidewall. Also included are second means for supplying a combustible fuel to the secondary burner.

In accordance with another aspect of the present invention, the primary burner includes means to produce turbulent vortices of the effluent gases entering thereinto whereby thorough intermixing of the effluent gases and combustible fuel will be promoted within the primary combustion zone.

In accordance with another aspect of the present invention, the primary burner includes means for utilizing a small portion of the input gases for continuously cooling the primary burner sidewalls.

The principal object of the present invention is the provision of a new two stage burner which may be employed in consuming odorants from gaseous materials.

Another object of the present invention is the provision of a two stage burner which is simple and economical.

Another object of the present invention is the provision of a two stage burner which heats the outlet gases to high temperature levels while maintaining reasonable outlet temperature uniformity and operating at a low pressure loss.

Still another object of the present invention is the provision of a two stage burner having sufficient flexibility for application over a wide range of input gas flow rates while maintaining near complete oxidation of odorants, reasonable outlet temperature uniformity and low pressure loss.

A still further object of the present invention is the provision of a two stage burner which is operable over a wide range of outlet temperatures, including very high outlet temperatures, while maintaining near complete oxidation of odorants, reasonable outlet temperature uniformity and low pressure loss.

Yet a further object of the present invention is the provision of a two stage burner which is readily adaptable to use in any number of environments.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein.

DETAILED DESCRIPTION OF THE PREFERRED EMBODIMENT

Figure 1:
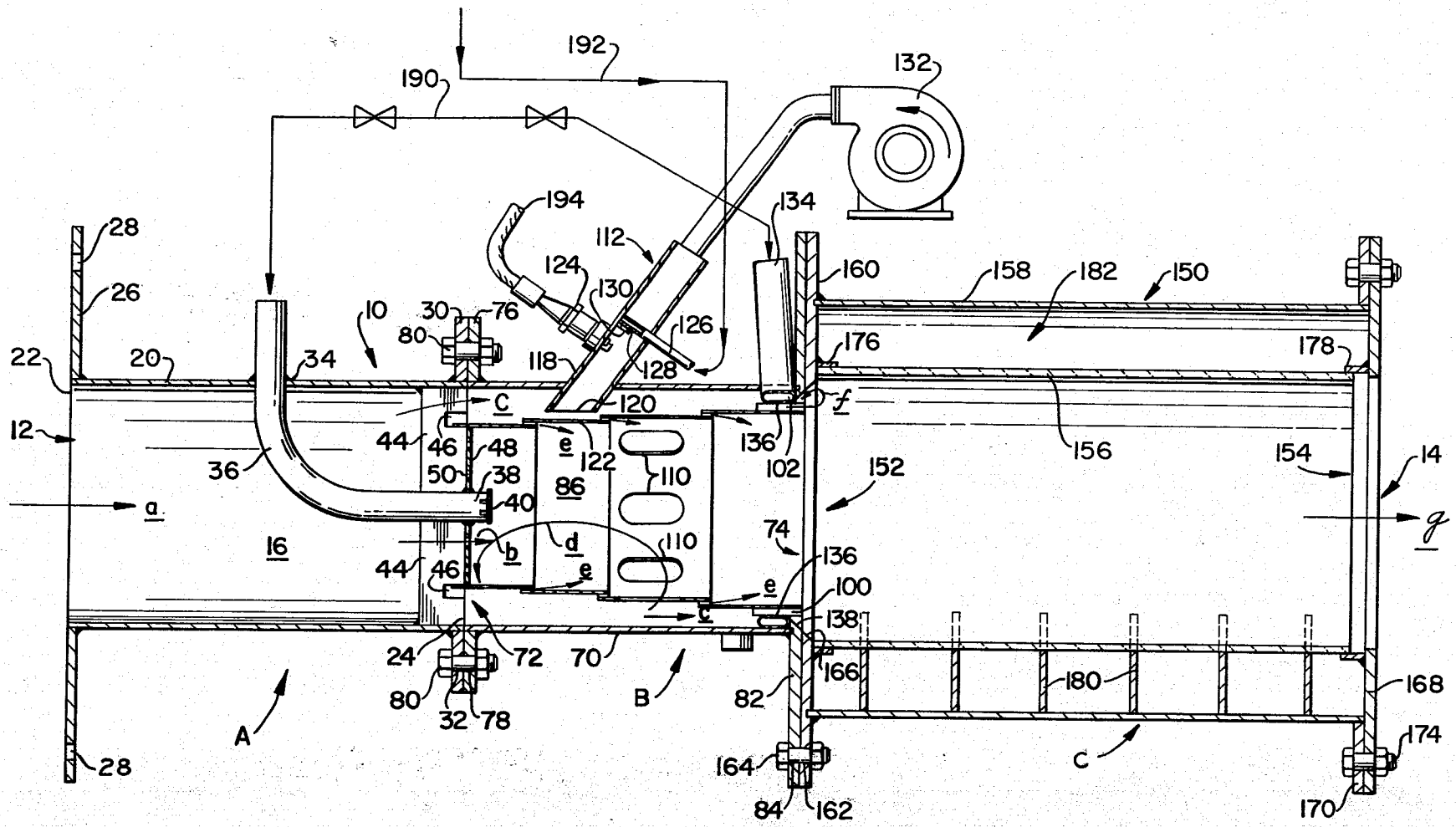
FIG. 1 is a cross-sectional view of the subject invention, in partial schematic, showing all the components thereof in their relative assembled positions.

Referring now to the drawings wherein the showings are for purposes of illustating the preferred embodiment of the invention only, and are not for purposes of limiting same, the FIGURES show a two stage burner which includes an effluent gas entrance area A, a primary burner area B and a secondary burner area C.

More specifically, areas A, B and C define a burner which includes a housing 10 having an effluent gas entrance or inlet area 12, an effluent gas exhaust or outlet area 14 with areas 12 and 14 being interconnected by an effluent gas flow path 16.

Effluent entrance area A is comprised of an elongated generally cylindrical shell structure 20 having an upstream or lead end 22 and a downstream or following end 24. Disposed at upstream end 22 is an annular mounting flange 26 having a plurality of mounting holes 28 spaced therearound to extend therethrough. These mounting holes are conveniently employed to rigidly affix the flange to a tube, pipe, duct or other vehicle (not shown) for transporting effluent gases to the burner. Inasmuch as such means do not form a part of the present invention, they are not shown or described more specifically herein. Disposed at downstream end 24 is an annular mounting flange 30 which includes a plurality of mounting holes 32 disposed therearound for interconnection with a similar flange on primary burner area B as will be described hereinafter. While cylindrical shell structure 20 and annular mounting flanges 26, 30 may be constructed from a number of materials, stainless steel is selected in the preferred embodiment of the invention.

Extending through the sidewall of shell 20 at area 34 is a primary fuel gas injector or supply line generally designated 36. In the preferred arrangement, this supply line is constructed from stainless steel and comprises a hollow tube having an outlet end 38 disposed generally coaxial with the shell structure itself. A multiple orifice nozzle 40 comprises an end cap for outlet end 38 and includes a plurality of orifices 42 (FIG. 2) therein. This multiple orifice nozzle arrangement insures that fuel will be supplied throughout the primary combustion zone within the primary burner to promote complete combustion as will be described in detail hereinafter. It should be noted, however, that either a combustible gaseous fuel or a combustible liquid fuel may be supplied through supply line 36. When liquid fuel is used, a pressure atomizing or air atomizing nozzle may be easily substituted for the gaseous fuel injector or supply line 36.

A plurality of retaining vanes 44 (FIGS. 1, 2 and 5) extend between shell structure 20 and outlet end 38 of supply line 36 in order to rigidly retain the supply line in position. While any number of vanes 44 may be advantageously employed, eight are used in the preferred embodiment. Each of these vanes includes a recessed or slitted area 46 for purposes of receiving a portion of the primary burner structure as will be described hereinafter in greater detail. Also disposed at outlet end 38 is a generally circular effluent gas inlet plate 48 which includes a plurality of inlet orifices 50 disposed therearound. As will be particularly noted from FIGS. 2, 5 and 6, two circular rows of inlet orifices 50 are contemplated in the preferred embodiment, although the number of rows and the relative locations of these orifices may be varied to accommodate the particular circumstances involved. Also in the preferred embodiment, inlet plate 48 is contemplated as being constructed from a nickel alloy sold under the trademark INCONEL, a trademark of The International Nickel Company, Inc. However, other materials could also be advantageously employed if desired.

Figure 5:
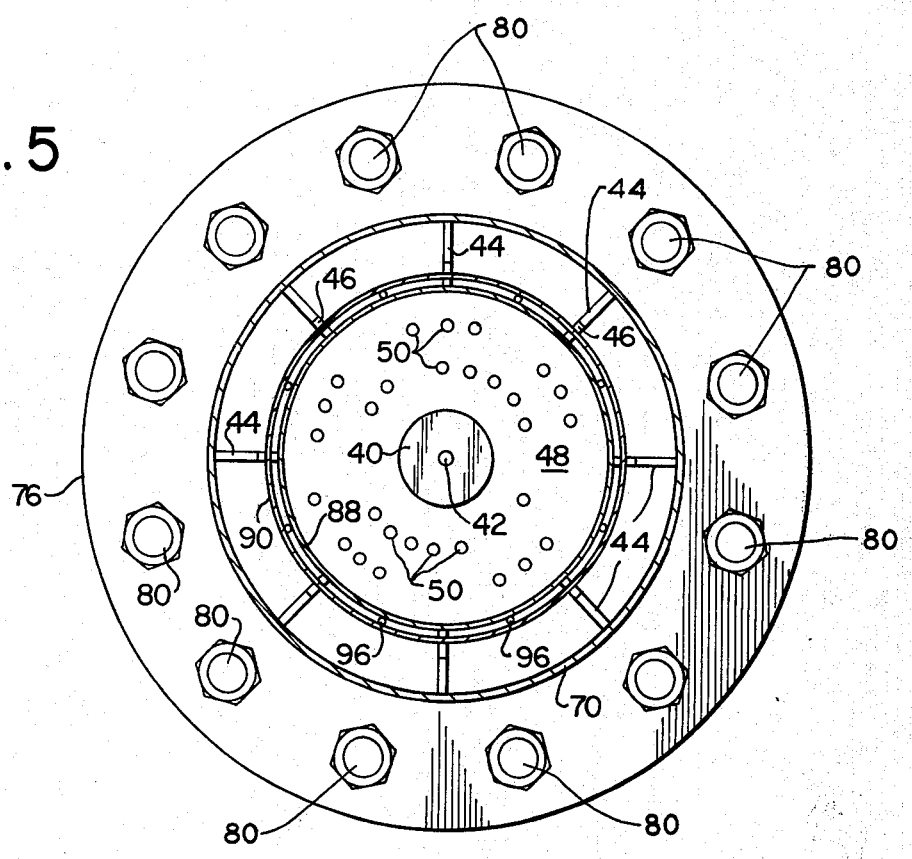
FIG. 5 is a cross-sectional view taken along lines 5—5 of FIG. 2.
Figure 6:
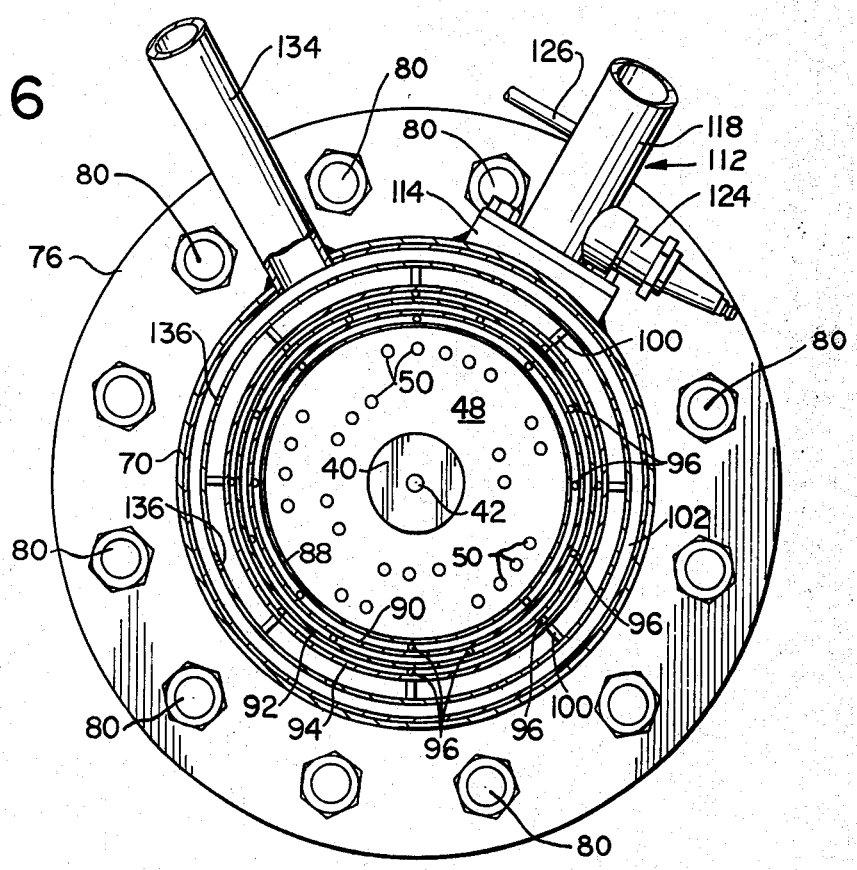
FIG. 6 is a cross-sectional view taken along lines 6—6 of FIG. 2.

With particular reference to FIGS. 1, 5 and 6, primary burner area B is comprised of an elongated generally cylindrical shell structure 70 having a lead or upstream end 72 and a following or downstream end 74. Disposed adjacent upstream end 72 is an annular mounting flange 76 having a plurality of mounting holes 78 disposed therearound for alignment with mounting holes 32 of flange 30. These flanges include an asbestos gasket (not shown) therebetween and are rigidly affixed to each other by means of threaded fastener arrangements generally designated 80. Disposed adjacent downstream end 74 is an enlarged mounting flange 82 having a plurality of mounting holes 84 disposed peripherally therearound. As with shell 20 and flanges 26,30, the construction of shell structure 70 and mounting flanges 76,82 are contemplated to be from stainless steel.

Figures 2, 3, 4:
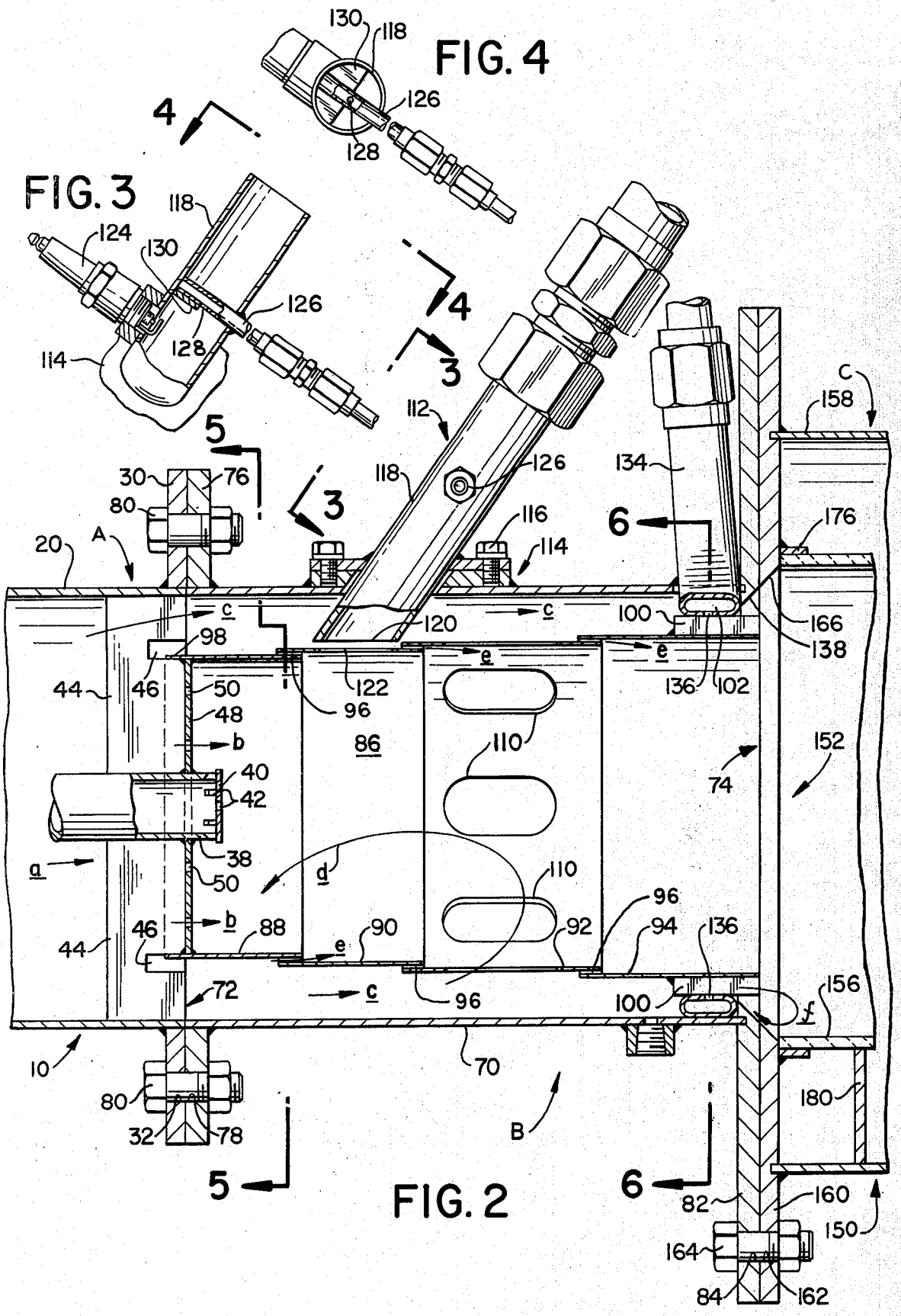
FIG. 2 is an enlarged cross-sectional view of the primary burner portion of the subject invention.
FIG. 3 is a partial cross-sectional view taken along lines 3—3 in FIG. 2.
FIG. 4 is a view in partial cross-section taken along lines 4—4 of FIG. 3.

In FIG. 1, there is shown a segmented primary burner generally designated 86 substantially centrally disposed within shell structure 70 and having a smaller cross-sectional dimension than the shell. This primary burner defines a primary combustion zone. As will be noted in FIG. 1, and although segmented, the primary burner has a generally frusto-conical configuration. As best shown in FIGS. 2, 5 and 6, it will be seen that the primary burner is comprised of a plurality of overlapping, cylindrical segments 88,90,92 and 94. Each following segment from upstream end 72 has a slightly larger inside diameter than the outside diameter of the preceding segment. Thus, slight gaps are created between successive segments, the specific purpose for which will be more fully described hereinafter. To properly position the cylindrical segments relative to each other so that these gaps are actually generally annular in configuration, a plurality of spacing pins 96 are employed between each successive segment. FIGS. 5 and 6 best show spacing pins 96 and, in the preferred embodiment, eight such pins are employed between successive segments although a greater or lesser number could be used as required.

In FIGS. 1 and 2, it will be seen that lead end 98 of cylindrical segment 88 is received in recess areas or slots 46 of vanes 44. This arrangement provides for positive location of the overall segmented primary burner 86 in a coaxial disposition relative to cylindrical shell 70. Gas inlet plate 48 is closely received and conveniently affixed to the inside of segment 88 adjacent upstream end 98. At the downstream end 74 of shell 70, a plurality of vanes 100 are disposed between cylindrical segment 94 and a secondary fuel supply or manifold 102 for retaining the overall segmented primary burner 86 in proper position at that end. FIGS. 2 and 6 best show this particular arrangement in the greatest detail where eight such vanes are preferably employed. According to the preferred arrangement of the present invention, at least cylindrical segments 88,90,92 and 94 are constructed from INCONEL. Cylindrical segment 92 includes a plurality of elongated effluent gas inlets or slots 110 disposed circumferentially therearound. Eight such slots are contemplated in the preferred embodiment, although a greater or lesser number may be advantageously employed. The function of these slots will be described in greater detail hereinafter.

As best shown in FIGS. 2, 3 and 4, an ignitor or flame thrower assembly generally designated 112 is disposed outside of shell structure 70 and is mounted to the shell by means of a convenient bracket assembly generally designated 114. This bracket assembly may be conveniently releasably mounted to the shell through conventional mechanical fasteners 116 or the like. Ignitor assembly 112 includes an elongated ignitor tube 118 having an end 120 protruding through shell structure 70 into close spaced communication with cylindrical segment 90 of primary burner 86. Segment 90 itself includes a hole 122 therein in order that the ignition flame may penetrate the primary combustion zone defined by the primary burner. A spark generator or plug 124 (FIG. 3) is disposed on ignitor tube 118 outside of shell structure 70 and communicates with the interior of the tube. A fuel gas inlet 126, for supplying fuel to tube 118, is positioned on the tube immediately adjacent and above plug 124. This fuel gas inlet includes a single orifice 128 therein and a half round baffle 130 is disposed immediately adjacent inlet 126 toward spark plug 124. The half round baffle is employed to introduce a recirculating zone in the vicinity of the terminal of the spark plug itself. A small, conventional blower generally designated 132 in FIG. 1 is employed for delivering air to ignitor assembly 112 for mixing with the fuel gas itself to promote combustion and to develop a flame thrower effect whereby an ignition flame may be directed outwardly of end 120, through hole or opening 122 and directly into the primary combustion zone. This ignitor system is deemed to insure reliable starts and eliminate ignition problems that might otherwise be caused by excessive moisture in the effluent gases being processed.

FIGS. 2 and 6 best show that secondary fuel manifold 102 comprises a tubular configuration surrounding and spaced from cylindrical segment 94 against the side wall thereof. A secondary fuel gas supply line 134 penetrates shell structure 70 into communication with manifold 102. The manifold itself includes a plurality of gas outlet ports 136 spaced circumferentially therearound on the inside diameter thereof for supplying fuel to effect combustion within the secondary burner which will be described in greater detail hereinafter. As with the primary fuel supply, either gaseous or liquid fuel may be employed with the secondary fuel supply. It should also be noted here that inner edge of annular flange 82 is beveled outwardly at 138 from the primary burner area B to the secondary burner area C. This beveling is advantageously employed to cause a particular desired effluent gas flow through the secondary burner which will also be described hereinafter.

With particular reference to FIGS. 1 and 2, it will be seen that secondary burner area C is comprised of an elongated generally cylindrical shell structure 150 having a lead or upstream end generally designated 152 and a following or downstream end generally designated 154. The shell structure itself is comprised of coaxial and spaced apart inner and outer shells 156,158, respectively. According to the preferred embodiment of the present invention, the inner shell is constructed from a refractory material and the outer shell is constructed from a stainless steel. Mullite is preferred as the refractory material although other materials could also be advantageously employed. While not essential for the performance of the subject burner, the refractory inner shell reduces heat losses and quenching of activated chemical species to thereby promote more complete combustion in the secondary combustion zone. Disposed adjacent upstream end 152 is a mounting flange 160 including a plurality of mounting holes 162 therein alignable with holes 84 in flange 82. An asbestos gasket (not shown) is placed between the mating faces of the two flanges which are then retained in a rigid relationship relative to each other by means of conventional mechanical or threaded fasteners 164. The inner edge of annular flange 160 is dimensioned to include a beveled area 166 fully compatible with beveled area 138 of flange 82. Again, the function of this beveled area will be described in greater detail hereinafter. An annular end flange 168 is disposed at downstream end 154 and an asbestos gasket 170 is disposed immediately inboard of flange 168 surrounding outer shell 158. Gasket 170 is retained in rigid position on flange 168 by means of a plurality of mechanical or threaded fasteners 174. Mounting flanges 160,168 are preferably constructed from a stainless steel.

Disposed on the inner faces of flanges 160,168 are locating and receiving brackets 176,178, respectively. These brackets merely comprise short tubular shaped members for receiving the outermost ends of inner shell 156. For positively supporting inner shell 156 relative to outer shell 158, there are provided a plurality of cradle forming members 180 disposed at spaced intervals between the outer surface of inner shell 156 and the inner surface of outer shell 158 at the lowermost side of the assembly. The annular area or zone 182 defined between these two shells is preferably packed with a high temperature fiberglass installation.

With fuel gas supply lines 36,134 connected to a supply of fuel schematically designated 190, and with fuel gas inlet 126 similarly connected to a source of fuel gas schematically designated 192, operation of the two stage burner above defined will hereinafter be made. In addition, spark generator or plug 124 is suitably connected to a source of electrical energy not shown by lead wire 194. While two sources of fuel have been shown in the drawings, it will be readily apprciated that the fuel supply may emanate from a single source.

OPERATION

With reference to FIGS. 1 and 2, effluent gas is piped from a plant or any other facility to the burner into entrance area A at gas entrance or intake area 12 by means of conventional blowers and ducts. The flow of the effluent gas here is designated *a* and the blower and ducts are not shown since they do not form a part of the present invention. However, this equipment may be placed in any critical area of a plant or facility where odorous gases issue. The effluent gas is normally actually comprised of an essentially nonflammable mixture of air and odorant laden gases.

The gases flow axially along entrance area A and a portion thereof flow through inlet orifices 50 disposed in gas inlet plate 48. This gas flow is generally designated by arrows *b* shown in FIGS. 1 and 2. Since plate 48 acts as a partial blockage for gas flow through the housing, that gas which does not flow through inlet orifices 50 is directed around the periphery of primary burner 86 as shown by arrows *c*. A portion of this gas, in turn, enters into the primary combustion chamber through gas inlets 110 as shown by arrows *d* and still another portion passes between the annular gaps defined between the individual cylindrical segment 88,90,92 and 94 as shown by arrows *e*.

Gas inlets 110 are arranged so as to induce large scale recirculating gas flow vorticies at the upstream end of the primary combustion zone. Such recirculation, shown by the path of arrows *d*, produce good fuel-air mixing and insures continuous ignition and combustion of the inflowing air, odorants and fuel by continuously recirculating hot combustion products and still burning gases and mixing these hot interreacting gases with the inflowing gases. Of course, during gas flow into gas entrance or intake area 12, ignitor assembly 112 continuously supplies a torchlike ignition flame into the primary combustion chamber through opening 122 in cylindrical segment 90. Blower 132, applying a continuous positive pressure through tube 118 assures this flame thrower type of arrangement. Overheating of segments 88,90,92 and 94 which comprise the side walls of primary burner 86 is avoided by the convenient admission of some effluent gases between the gaps created at the overlapping areas of the individual segments as shown by arrows *e* in the drawing. Admission of gases along direction *e* acts to provide a thin cooling film of gas along the inner walls of the segments. At continuing intervals, as the thin film of cooling gas becomes heated by contact with the combustion gases themselves, the film is replenished by additional gases continuously entering the primary burner through these gaps along direction *e*. Due to the continuous input of effluent gases at entrance or inlet area 12, the process of gases entering the primary combustion zone is continuous with those gases already reaching combustion within the primary combustion zone exiting the primary burner adjacent downstream end 74 of shell 70.

The greater or a substantial portion of effluent gases entering entrance or inlet area 12 continue to flow along the annular passage defined between the primary burner and shell 70 in direction *c*. That is, most of the entering effluent gases entirely bypass the primary combustion zone and enter the secondary combustion zone at upstream end 152 of shell structure 150 as an annular stream of gases. Additional or secondary fuel gas is injected into this flow of effluent gases through the multiple orifices 136 in manifold 102. The inflowing effluent gases and the secondary fuel then enter the secondary combustion zone defined, in this instance, by the inside of mullite inner shell 156. Inner shell 156 has a larger cross-sectional area then the upstream flow area defined by shell 70, the transition zone between the two areas is comprised of beveled areas 138,166. As the gases flow passed areas 138,166, flow recirculation generally designated by arrows *f* in FIGS. 1 and 2 is created adjacent the inner wall of inner shell 156. Combustion in the secondary combustion zone is, through this action, anchored against the inner shell as the gases pass axially along the secondary combustion zone from upstream end 152 toward downstream end 154. Ignition of the combustible mixture entering and moving through the secondary combustion zone is provided by the hot gases and activated species emerging from the primary combustion zone for passage through the secondary combustion zone to atmosphere. All gases, following combustion in either the primary or secondary combustion zones, exhaust outwardly of the two stage burner to atmosphere as generally shown by arrow *g* in FIG. 1. The burning process just described is continuous as the plant or facility is in operation and generating undesirable malodorous gaseous effluents. The products of combustion when typical malodorous gaseous effluents are processed in accordance with the subject invention comprise carbon dioxide, water vapor and non-objectionable gases.

Again, the subject invention is deemed to provide a valuable advance in the state of the art in providing a new two stage burner and method for consuming odorants contained in gaseous effluent and converting these odorants to non-objectionable matter. Another advantage which may be obtained when using the subject invention is that it is designed to operate over a wide range of outlet temperatures, particularly very high temperatures, while maintaining near complete oxidation of input organics and maintaining reasonable outlet temperature uniformity. Thus, the burner can be initially operated at very high outlet temperatures to insure complete elimination of odors from all gases delivered to the burner. With this assurance, any odors which are detected while using the burner will be known to originate from sources within the plant, factory or facility which have not yet been properly contained and piped to the burner for processing. Such secondary sources of odor are often not even detectable until the more intense, primary odors have been eliminated. Once all odor sources have been identified, contained and piped to the burner, the fuel flow to the burner to promote combustion may be reduced in a stepwise manner until the odor threshold is determined. Such corrective adjustment will provide the most economical operating setting for the burner when employed in a continuous manner.

The invention has been described with reference to the preferred embodiment. Obviously, modifications and alterations will occur to others upon the reading and understanding of this specification. It is my intention to include all such modifications and alterations insofar as they come within the scope of the appended claims or the equivalents thereof.

Having thus described my invention, I now claim:

1. A two stage burner for oxidizing odorants contained in a gaseous effluent supply, said burner comprising:

an elongated burner housing including a gas flow passageway interconnecting an effluent gas inlet and a gas outlet with said inlet adapted to continuously receive a supply of effluent gas which is passed from said inlet toward said outlet through said passageway;

a primary burner disposed in said housing and longitudinally spaced in said passageway from said gas inlet toward said gas outlet and defining a primary combustion zone, said primary burner having a burner end wall generally transversely disposed in said passage and a burner side wall extending from said burner end wall toward said gas outlet with the terminal end thereof defining a gas exit area and with said burner side wall and burner housing defining a gas flow channel therebetween, said primary burner including first means for allowing a portion of said continuous supply of effluent gas to flow into said primary combustion zone through said primary burner end wall generally longitudinally of said passageway and through said primary burner side wall with at least some of the effluent gas entering said primary combustion zone through said primary burner side wall inducing recirculation gas flow vortices in said primary combustion zone adjacent at least said primary burner end wall, the remainder of said effluent gas flowing past said primary burner and combustion zone through said gas flow channel;

first means for separately supplying a combustible fuel to said primary combustion zone adjacent said burner end wall for mixing with at least a portion of effluent gas;

means communicating with said primary combustion zone for igniting the mixture of fuel and effluent gases therein;

a secondary burner disposed in said housing and having a secondary burner side wall defining an elongated secondary combustion zone having a greater cross-sectional dimension than the cross-sectional dimension than the exit area of said primary combustion zone area, said secondary combustion zone having an entrance area adjacent the exit area of said primary combustion zone and an exhaust area spaced toward said gas outlet, said primary and secondary combustion zones in longitudinal gas flow communication with each other with said secondary burner including second means for allowing said remainder of effluent gas to flow into said secondary combustion zone;

means disposed adjacent said secondary combustion zone entrance area for producing turbulent recirculation vortices in said remainder of effluent gas whereby said remainder passes through said secondary combustion zone closely spaced to the secondary burner side wall, said at least a portion of said gas exiting from said primary combustion zone passing generally longitudinally through said secondary combustion zone toward said burner housing gas outlet; and, second means for separately supplying a combustible fuel to said secondary combustion zone adjacent the entrance area thereof for mixing with said remainder of said effluent gas to promote combustion thereof throughout said secondary combustion zone, the mixture of combustible fuel and said remainder of effluent gas being ignited by combustion in said primary combustion zone.

2. The two stage burner as defined in claim 1 wherein said primary burner side wall has an elongated generally frusto-conical configuration increasing in cross sectional dimension from said end wall toward said exit area and is generally coaxially disposed in said housing, said housing and said primary burner defining a generally annular effluent gas flow channel therebetween.

3. The two stage burner as defined in claim 2 wherein said primary burner end wall comprises a cover plate, said cover plate having a plurality of first gas flow passages therethrough to facilitate effluent gas flow therethrough generally longitudinal of said burner passageway into said primary combustion zone.

4. The two stage burner as defined in claim 3 wherein the side wall of said primary burner includes a plurality of second gas flow passages spaced therealong to facilitate effluent gas flow therethrough into said primary combustion zone to induce said recirculation gas flow vortices adjacent at least said primary burner cover plate.

5. The two stage burner as defined in claim 4 wherein said second gas flow passages comprise a plurality of openings elongated generally longitudinally of said primary burner and spaced apart from each other circumferentially around the side wall of said primary burner.

6. The two stage burner as defined in claim 2 further including means for cooling the side walls of said primary burner.

7. The two stage burner as defined in claim 6 wherein said cooling means comprises gas flow passages spaced axially along and circumferentially around said primary burner side wall.

8. The two stage burner as defined in claim 7 wherein said frusto-conical side wall configuration is comprised of a plurality of separate generally cylindrical segments spaced axially of each other, said segments increasing in diameter from said primary burner end wall to said primary combustion zone exit area.

9. The two stage burner as defined in claim 8 wherein successive ones of said plurality of segments from said primary burner end wall are in a radially spaced apart relationship from the preceding segment, the spaces between adjacent segments comprising annular passages defining said cooling gas flow passages whereby a small portion of said at least a portion of said effluent gas passes through said cooling gas flow passages to provide a cooling gas film along the inside of said primary burner side wall.

10. The two stage burner as defined in claim 3 wherein said first means for supplying a combustible fuel comprises a fuel supply line communicating with the inside of said primary combustion zone for supplying fuel thereto immediately adjacent said cover plate.

11. The two stage burner as defined in claim 10 wherein said supply line includes a multiple orifice outlet at the outermost end thereof for equally dispersing fuel within said primary combustion zone.

12. The two stage burner as defined in claim 1 wherein said igniting means comprises an ignition fuel supply having an outlet communicating with said primary combustion zone and in operative association with a spark generator.

13. The two stage burner as defined in claim 1 wherein said means for producing turbulent recirculation vortices in said remainder of said effluent gas comprises an area of said burner housing sharply increasing in cross-sectional dimension at the area thereof disposed immediately preceding said secondary combustion zone entrance area, said increase in cross-sectional dimension defining a circumferential band causing continuous recirculation vortices of said remainder of said effluent gas whereby said remainder is caused to flow axially through said secondary combustion zone in a close spaced relationship with and substantially surrounding the gas exiting said primary combustion zone and passing through said secondary combustion zone toward said burner housing outlet.

14. The two stage burner as defined in claim 1 wherein said secondary burner side wall is constructed from a refractory material for reducing heat losses and for promoting more complete combustion in said secondary combustion zone.

15. The two stage burner as defined in claim 1 wherein said second fuel supply means is disposed immediately adjacent and upstream of said means for producing turbulent recirculation vortices, said second fuel supply means including means for evenly distributing fuel into said remainder of effluent gas to promote complete combustion thereof in said secondary combustion zone.

16. The two stage burner as defined in claim 15 wherein said second fuel supply means comprises a multi-orificed fuel supply manifold extending generally circumferentially around the inside of said burner housing, the orifices in said manifold being substantially evenly disposed about said manifold.

* * * * *